US005156208A

United States Patent [19]

Masuki et al.

[11] Patent Number: 5,156,208

[45] Date of Patent: Oct. 20, 1992

[54] HEAT PIPE UNIT AND PARTITION PANEL

[75] Inventors: Hirofumi Masuki, Ichikawa; Iwao Sawada, Osaka; Masahiro Adachi, Osaka; Akihiko Sakai, Osaka; Makoto Koganei, Tokyo, all of Japan

[73] Assignees: Asahi Kogyosha Co., Ltd., Tokyo; Sasakura Engineering Co., Ltd., Osaka, both of Japan

[21] Appl. No.: 666,116

[22] Filed: Mar. 7, 1991

[51] Int. Cl.[5] ..... F28D 15/02

[52] U.S. Cl. ..... 165/104.26; 165/56; 165/49; 165/104.21; 62/333

[58] Field of Search ..... 165/104.21, 104.26, 165/56, 49; 392/357, 358, 359, 377, 378; 62/333

[56] References Cited

U.S. PATENT DOCUMENTS 4,279,294 7/1981 Fitzpatrick et al. ..... 165/104.26
4,909,316 3/1990 Kamei et al. ..... 165/104.26

FOREIGN PATENT DOCUMENTS 2525757 10/1983 France ..... 165/104.21
161149 12/1979 Japan ..... 165/104.26

*Primary Examiner*—Albert W. Davis, Jr.
*Attorney, Agent, or Firm*—Dykema Gossett

[57] ABSTRACT

A heat pipe unit comprising a relatively thin box-shaped panel body in which coolant is charged, a heat-transfer pipe provided in an upper area in the panel body in which cooling fluid is fed and a device for guiding to an inner wall of the panel body the coolant liquified by the heat-transfer pipe.

8 Claims, 6 Drawing Sheets

HEAT PIPE UNIT AND PARTITION PANEL

BACKGROUND OF THE INVENTION

1. Technical Field

The present invention relates to a heat pipe unit for room-air conditioning taking advantage of radiant heat and a partition panel using such a heat pipe unit, and particularly to a partition panel for keeping one's head cool and feet warm by the radiant heat.

2. Background Art

Generally, a heat pipe unit has a pipe which is lined with wicks and coolant is charged into the pipe. The coolant is vaporized as one end of the pipe is heated, and the vaporized gas is condensed at the other end of the pipe due to radiation. Heat is transferred to the other end from the one end as the liquid produced upon condensation returns to the one end via the wicks. A panel-shaped heat pipe unit which incorporates such a heat pipe has been developed in the art and this type of heat pipe unit is used for the air-conditioning of a room. For example, such type of heat pipe units are disclosed in Japanese Patent Application Publication No. 61-190291 and Japanese Utilitiy Model Registration Publication No. 2-36779. Manufacturing cost is reduced and scope of applications is widened by shaping the heat pipe into a panel-shape. In addition, comfortable air condititioning is realized by the panel-like heat pipe unit.

As mentioned above, air conditioner which incorporates the panel-like heat pipe is well known, but no conventional partition panel incorporates such a heat pipe. Further, in a case where the panel-like heat pipe is used in the air conditioner, it is necessary to form in the panel very complicated passages for the cooling and heating fluid.

SUMMARY OF THE INVENTION

An object of the present invention is to provide a panel-type heat pipe unit which is easy to assemble and can realize comfortable air conditioning.

Another object of the present invention is to provide a partition panel which incorporates an air-conditioning heat pipe unit and whose feeding-and-discharging of the cooling and heating fluid is simplified.

According to one aspect of the present invention, there is provided a heat pipe unit which comprises: a panel body of relatively thin box-shape with coolant being enclosed therein; a heat-transfer pipe provided in an upper space inside the panel body with cooling fluid being fed thereinto; and means for guiding into the panel body the coolant liquified (condensed) by the heat-transfer pipe. The guide means includes a number of vertical plates, a grid body for connecting the vertical plates to each other and a wick attached over the grid body. The lower portion of the wick extends between the grid body and the inner wall of the panel body. The vertical plate has approximately same width as the inner width (between the front inner wall and the rear inner wall) of the panel body. The coolant condensed in the heat-transfer pipe drops from the heat-transfer pipe and then the droplets are divided left and right due to capillary phenomenon by the guide means (the grid body, the wick and so on) and flow along the inner wall of the panel body. The droplets recieve heat from the outside of the panel body and get vaporized as they flow the inner wall of the panel body. Then, the vapor reaches again (or returns to) the heat-transfer pipe located upward and is cooled again by the cooling fluid flowing through the heat-transfer pipe. Therefore, the heat pipe unit works as a desired cooling machine.

According to another aspect of the present invention, there is provided a partition panel which comprises: a frame standing on a floor of a room; an upper panel body mounted in an upper space of the frame with coolant being charged into the upper panel body, the upper panel body being shaped like a relatively thin box; a lower panel body mounted in a lower space of the frame with the coolant being charged therein, the lower panel body being also shaped like a relativeliy thin box; an upper heat-transfer pipe extending in an upper space inside the upper panel body; a lower heat-transfer pipe extending in a lower space inside the lower panel body; wicks mounted along or on an inner wall of the upper panel body; a fluid feed header provided at a lower end of the frame for feeding and discharging cooling and heating medium (fluid) into and from the upper and lower heat-transfer pipes; and a connecting pipe provided inside the frame or mounted on a lateral portion of the frame for feeding and discharging the cooling and heating medium to and from the upper and lower heat-transfer pipes from the fluid feeding header. The frame defines the upper space and the lower space by itself, and the upper panel body is provided in the upper space of the frame and the lower panel body is provided in the lower space of the frame. The fluid header which feeds the cooling fluid and the heating fluid is mounted on the lower end of the frame. The header and the upper and lower heat-transfer pipes are connected with each other by the connecting pipe extending inside the frame. Therefore, the structure of fluid-feeding and discharging is very simple. In addition, several pairs of upper and lower panel bodies may be arranged next to each other so as to obtain the partition panel of desired length. The panel bodies may be arranged in a straight line or an L-shaped line as viewed from a ceiling of the room. During the room-cooling, the coolant is fed to the upper heat-transfer pipe from the fluid feed header such that the upper panel body performs the cooling. During the room-heating, on the other hand, the fluid feed header supplies the heating fluid to the lower heat-transfer pipe such that the lower panel body performs the heating. Therefore, the partition panel can be used for the head-cool and feet-warm heating. The wick may be formed from metal meshes or cloth.

DESCRIPTION OF THE PREFERRED EMBODIMENTS

Preferred embodiments of the present invention will now be described with reference to the accompanying drawings.

Figure 1:
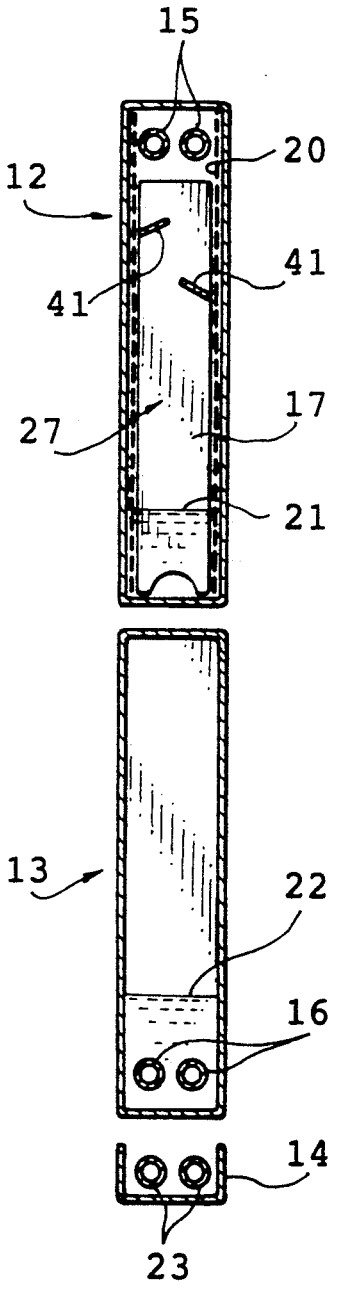
FIG. 1 is a schematic sectional view of a heat pipe unit of the present invention.

Referring to FIG. 1, shown is a perspective section of a heat pipe unit of the present invention. Numeral 12 designates an upper panel body, numeral 13 designates a lower panel body and numeral 14 designates a header for feeding and discharging cooling and heating medium (fluid) into and from the upper and lower panel bodies 12 and 13.

The upper panel body 12 is shaped like a box-type container, and coolant 21 such as freon, alcohol and water is charged into the upper panel body 12. An upper heat-transfer pipe 15 extends in upper space inside the upper panel body 12, and a guide means for guiding liquid coolant (condensed by the heat-transfer pipe 15 on the surface of the pipe 15) onto an inner wall of the panel body 12 is provided below the upper heat-transfer pipe 15. The guide means includes a grid body 27 and wick 20. The grid body 27 includes a plurality of vertical plates 17 located inside the panel body 12. The vertical plates 17 are spaced in a length direction (right and left direction in FIG. 2) of the panel body 12. The liquified or condensed coolant drops from the upper heat-transfer pipe 15 between the vertical plates 17. The droplets falling from the upper heat-transfer pipe 15 are guided to the interior of the panel body 12 by inclined plates 41 which connect the vertical plates 17 with each other. There are shown two plates 41 in FIG. 1, but the number of the plates 41 may be one or more than two The wick 20 is put over the grid body 27 to cover the grid body 27 almost entirely and contacts the inner wall of the panel body 12. In other words, the wick 20 extends between the grid body 27 and the inner wall of the panel body 12 such that the wick 20 contacts the inner wall of the panel body 20. The wick 20 may be formed from metal meshe, screen, gauze or cloth.

A lower panel body 13 is also shaped like a box-container, and coolant 22 such as freon, alcohol and water is charged thereinto. A lower heat-transfer pipe 16 extends in a lower space in the lower panel body 13.

Figure 2:
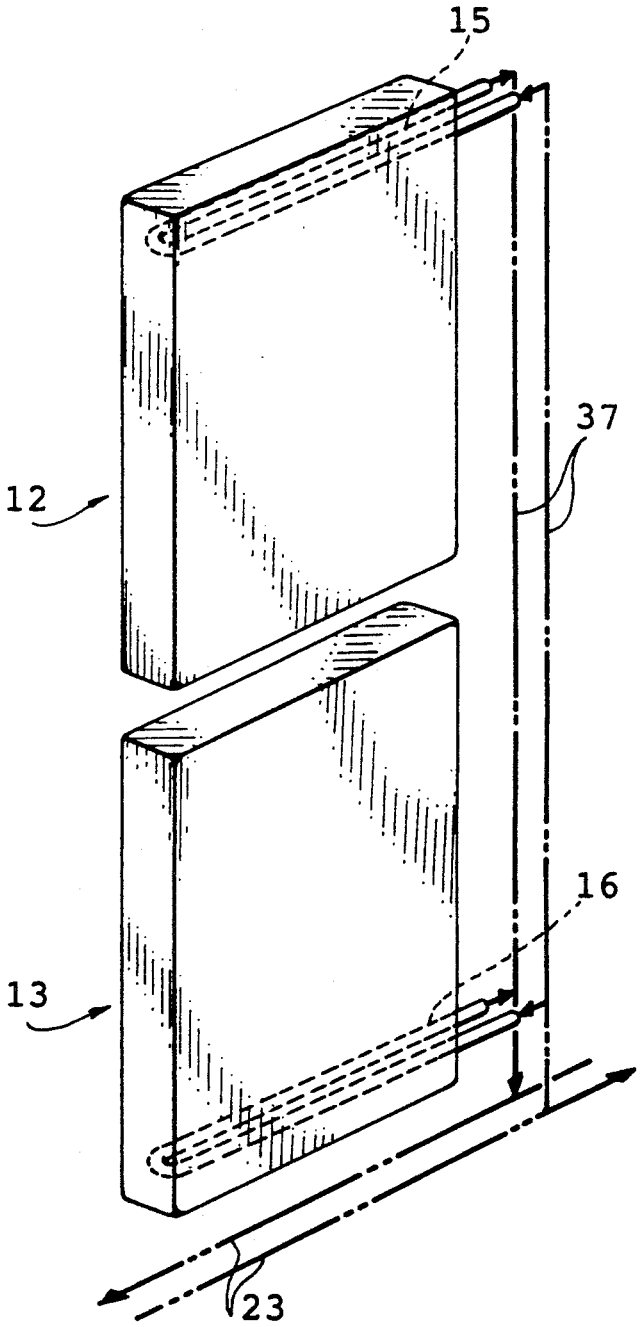
FIG. 2 is a perspective view of the heat pipe unit of FIG. 1.

Referring to FIG. 2, the upper heat-transfer pipe 15 of the upper panel body 12 and the lower heat-transfer pipe 16 of the lower panel body 13 are respectively shaped like a "U" and the ends of the pipes 15 and 16 extend outward from the panel bodies 12 and 13 respectively to be connected with connecting pipes 37. The connecting pipes 37 are connected with cooling and heating fluid feed and discharge pipes 23 extending below the lower panel body 13. The fluid feed and discharge pipes 23 extend to a fluid feed header 14. the pipes 23 are major elements of the header 14. The cooling medium is fed to and discharged from the upper heat-transfer pipe 15 during cooling operation whereas the heating medium is fed to and discharged from the lower heat-transfer pipe 16 during heating operation.

The cooling medium (fluid) is mainly fed to and discharged from the upper heat-transfer pipe 15 of the upper panel body 12 from and to the cooling and heating fluid feed and discharge pipes 23 via the connecting pipes 37 during the cooling operation. In other words, a small amount of cooling medium may also flow into the lower pipe 16 during the cooling operation. On the other hand, the heating medium (fluid) is mainly fed to and discharged from the lower heat-transfer pipe 16 of the lower panel body 13 during the heating operation. In other words, a certain amount of heating medium may also be fed to the upper pipe 15 during the heating operation.

During the cooling operation, the coolant 21 inside the upper panel body 12 is vaporized by heat input to the panel body 12 from outside. The vaporized gas is condensed by the cooling fluid flowing through the upper heat-transfer pipe 15 and the condensed liquid drops along the wick 20. The liquid is then vaporized again by heat coming into the panel body 12 as it drops along the wick 20, thereby performing the cooling of atmosphere. In this case, the cooling fluid may be fed to the heat-transfer pipe 16 of the lower panel body 13 but non-feeding is also satisfactory.

During the heating operation, the coolant 22 in the lower panel body 13 is heated and vaporized by the heating fluid flowing through the lower heat-transfer pipe 16. Then, the vapor is condensed due to radiation from the surface of the lower panel body 13 and heated again by the heating fluid, whereby the heating of a room is performed. Here, the heating fluid may be also fed to the heat-transfer pipe 15 of the upper panel body 12, but it may not as required. Consequentlty, the ideal cooling and heating (head-cool and feet-warm heating) can be realized. FIGS. 3 to 7 illustrate sectional views of modified panel bodies 12 respectively. Specifically, the guide means (the grid body 27, the wick 20 and so on) is modified.

Figure 3:
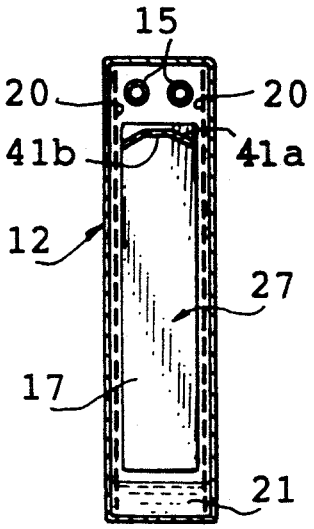
FIG. 3 is a sectional view of a modified version of an upper panel body of FIG. 1.

In FIG. 3, the vertical plates 17 are connected to each other by an upside-down basin-like guide member 41*a*. The guide member 41*a* is located below the upper heat-transfer pipe 15. The guide member 41*a* has two inclined parts which respectively extend from the opposite inner walls of the panel body 12 diagonally upward. The guide member 41*a* also has an opening 41*b* at a flat part thereof. In this example, the wick 20 does not cover the top of the grid body 27 but stands separately along the respective inner walls of the panel body 12. Condensed liquid, which drops from the heat-transfer pipe 15 is guided to the wick 20 by the inclined guide plates 41.

Figure 4:
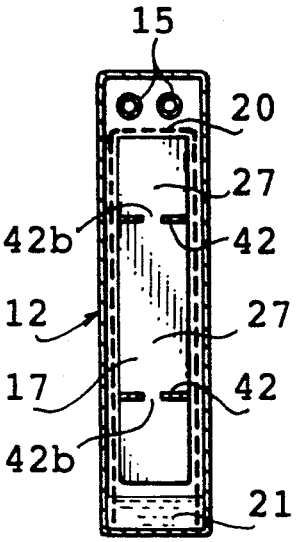
FIG. 4 is a cross sectional view of a modified version of FIG. 3.

In FIG. 4, the wick 20 covers the lateral portion and the top of the grid body 27, and the vertical plates 17 are connected to each other by two horizontally extending parallel members 42. The horizontal members 42 may have plural small holes such that the vapor can easily go up through the horizontal members 42.

Figure 5:
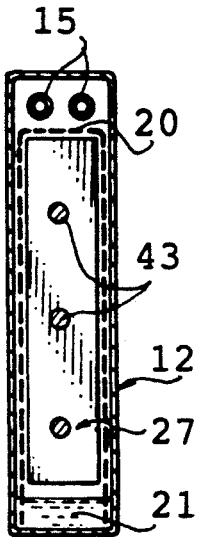
FIG. 5 is a cross section of another modified version of FIG. 3.

In FIG. 5, there are provided three rods 43 to connect the vertical plates 17. The rods 43 extend parallel to each other and are spaced in the height direction of the panel body 12.

Figure 6:
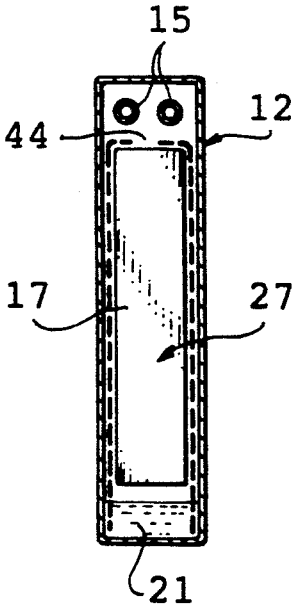
FIG. 6 shows a sectional view of a still another modified version of FIG. 3.
Figure 7:
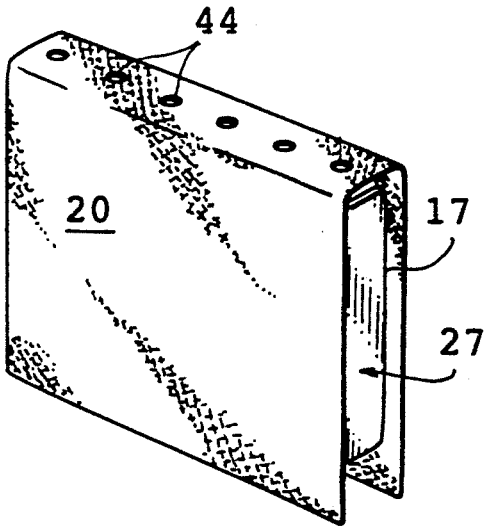
FIG. 7 illustrates a perspective view of a major portion of FIG. 6.

FIG. 6 shows a modified wick 20. Openings 44 are formed in the upper face of the wick 20. Specifically, as shown in FIG. 7, there are formed a plurality of openings 44 spaced in the longitudinal direction of the grid body 27. By forming the openings 44, the rising vapor is subjected to less flow resistance before reaching the upper heat-transfer pipe 15, rather than passing through the wick 20 having no openings.

Figure 8:
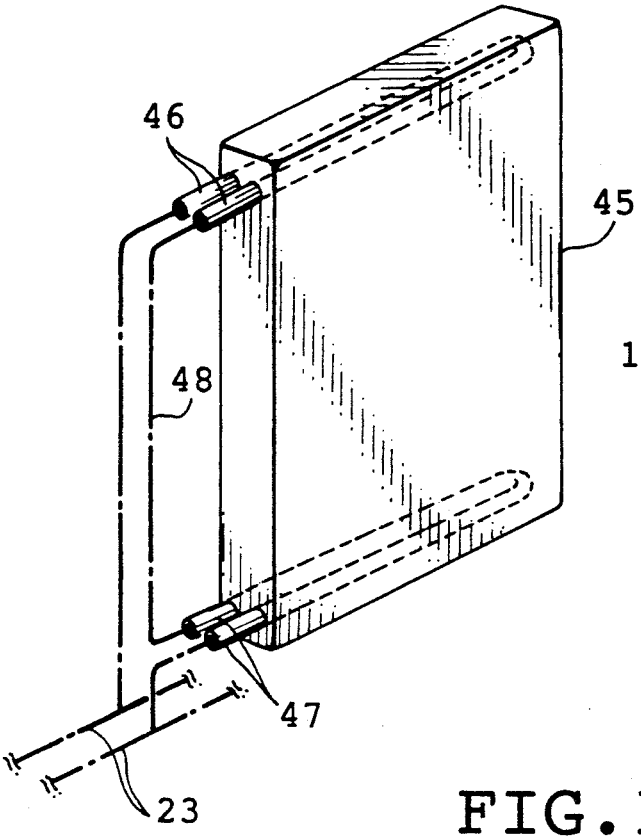
FIG. 8 illustrates another embodiment of the present invention.

FIG. 8 shows another embodiment of the heat pipe unit of the present invention. A U-shaped upper heat-transfer pipe 46 and a U-shaped lower heat-transfer pipe 47 are provided to extend in an upper area and a lower area in a box-shaped panel body 45 respectively. One end of the upper pipe 46 is connected to one end of the lower pipe 47 by a connecting pipe 48. The other end of the upper pipe 46 and the other end of the lower pipe 47 are respectively connected to cooling and heating fluid feed and discharge pipes 23 of the above-mentioned header 14. Inside the panel body 45, there is also provided the guide means of FIGS. 1 to 7.

In the embodiment of FIG. 8, during the cooling operation, the cooling fluid flows through the upper heat-transfer pipe 46 first and then through the connecting pipe 48 and the lower heat-transfer pipe 47. During the heating operation, on the other hand, the fluid flows through the lower pipe 47 first and then through the connecting pipe 48 and the upper pipe 46.

Figure 9:
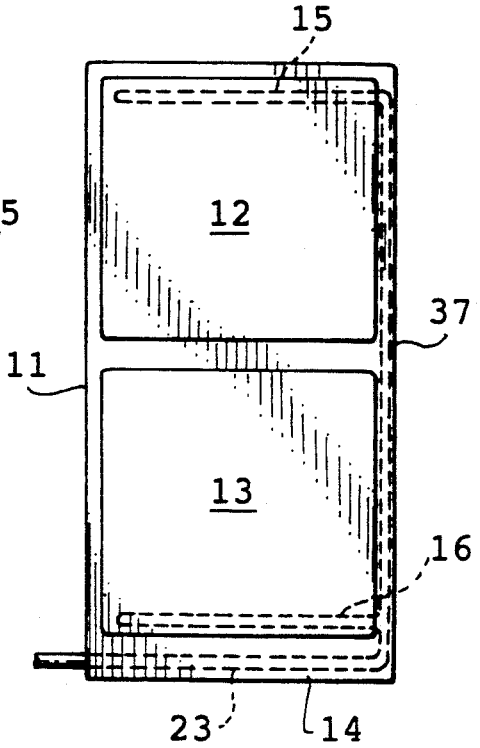
FIG. 9 illustrates a front view of a partition panel of the present invention.
Figure 10:
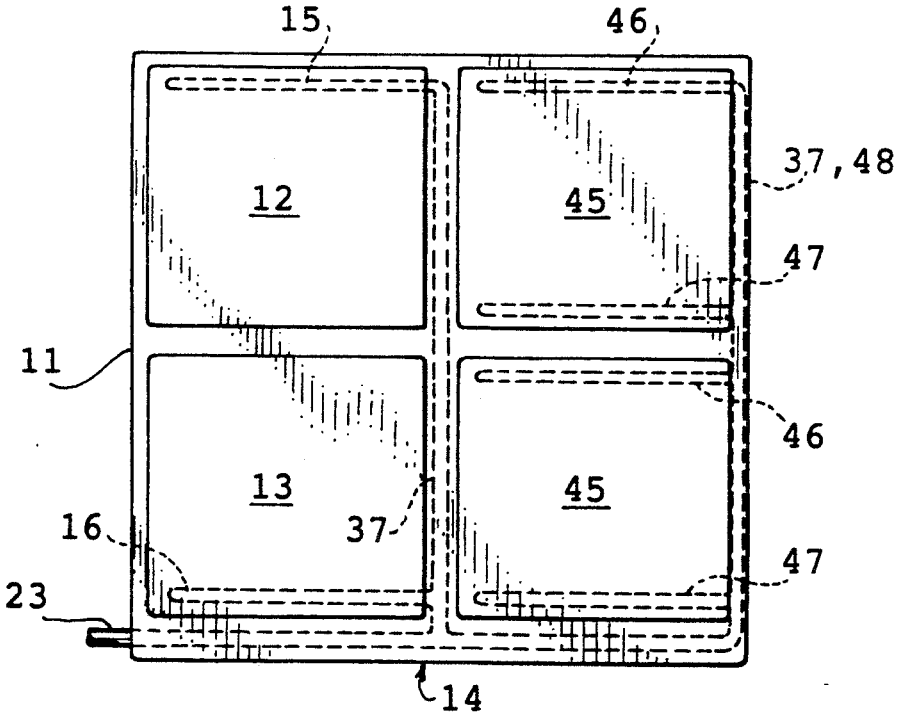
FIG. 10 depicts a front view of a modified version of FIG. 9.

FIGS. 9 and 10 show partition panels incorporating the above-described heat pipe unit.

Referring to FIG. 9, the partition panel includes a frame 11, an upper panel body 12, a lower panel body 13 and a header 14. The frame 11 is formed from steel sections and defines two spaces in a height direction thereof, namely an upper space and a lower space. The upper panel body 12 is mounted in the upper space and the lower panel body 13 is mounted in the lower space. The header 14 which is used to feed and discharge the cooling and heating fluid is provided in the lower part of the frame 11.

There may be formed four spaces in the frame 11. In such a case, two upper spaces are occupied by two upper panel bodies 12 and 12 and two lower spaces are occupied by two lower panel bodies 13 and 13 respectively.

The partition panel of FIG. 10 has also four panel bodies, namely, the panel bodies 12, 13, 45 and 45. These four panel bodies are arranged to define a sqaure. The panel body 12 is located above the panel body 13 like FIGS. 1 and 2, and another pair of panel bodies 45 and 45 (FIG. 8) are located next to the upper panel body 12 and the lower panel body 13 respectively.

Figure 11:
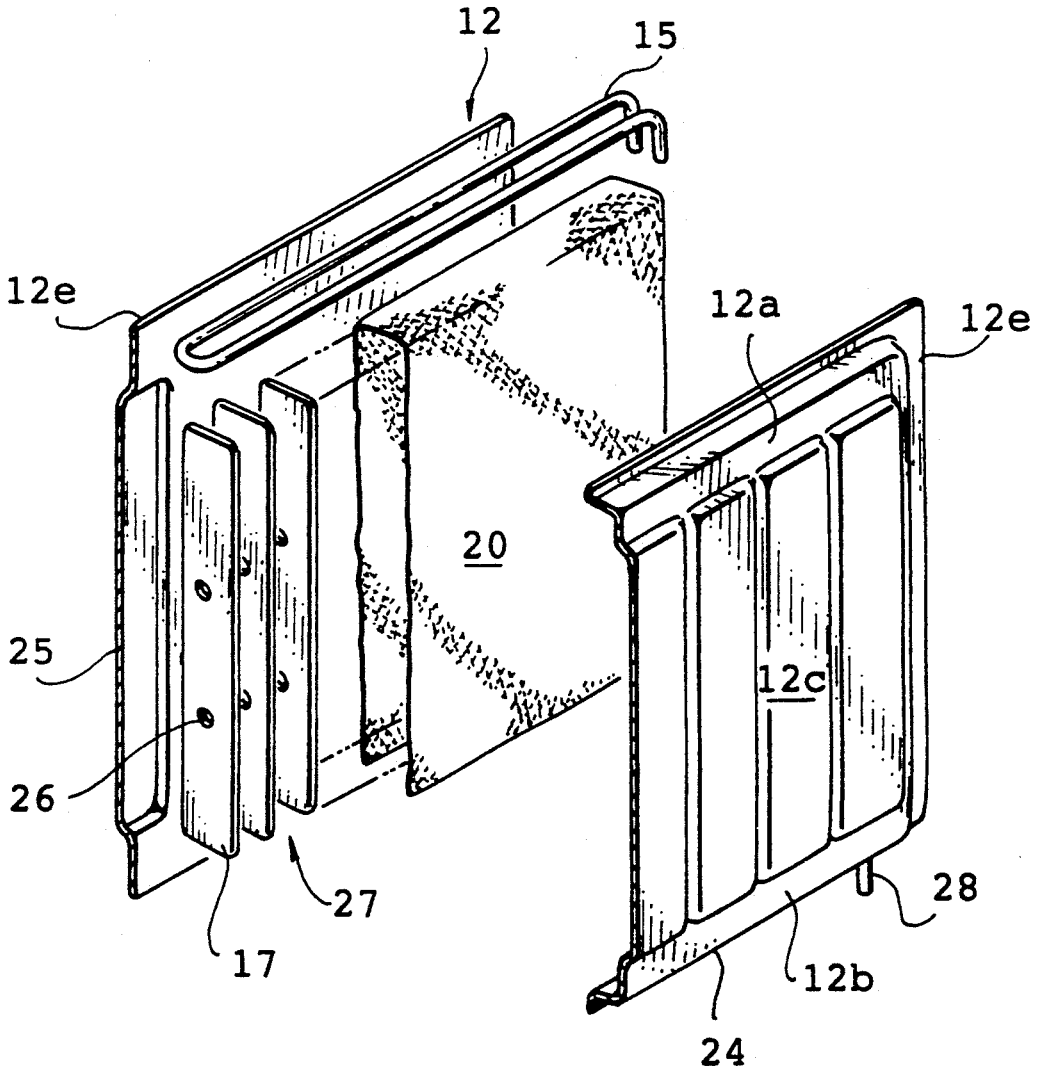
FIG. 11 is a detailed exploded view of an upper panel body of the present invention.
Figure 12:
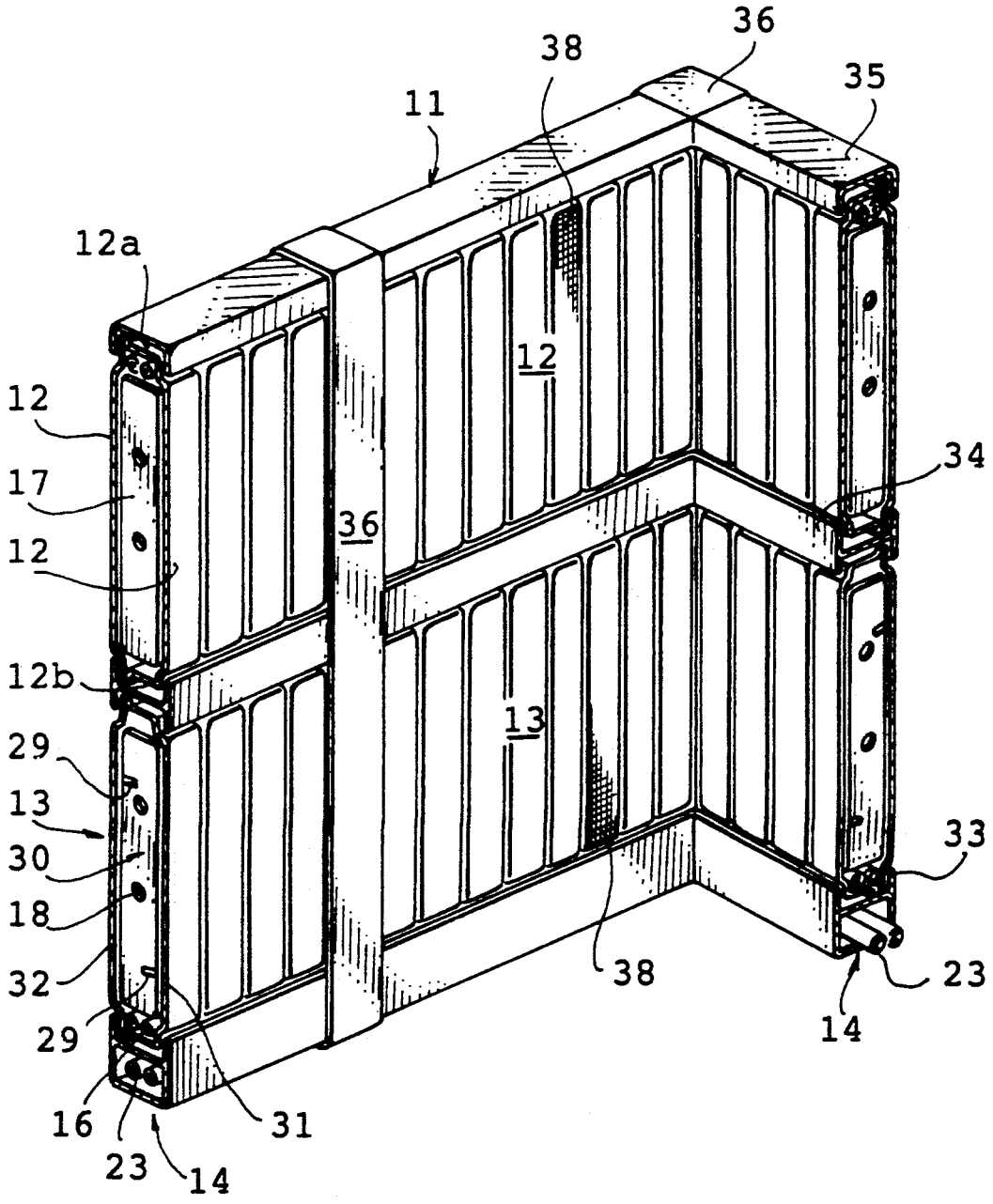
FIG. 12 is a partially broken perspective view of a partition panel incorporating the panel body of FIG. 11.

Other embodiments will be explained with FIGS. 11, 12 and 13.

First, a detail structure of the upper panel body 12 will be explained with FIG. 11. As illustrated, the upper panel member 12 includes a main panel plate 24 and an auxiliary panel plate 25. Edges of these plates 24 and 25 are seam-welded to each other to form a sealed container. An upper portion **12*a* and a lower portion 12*b* of the panel member 12 are shaped (squeezed) to form stepwise portions. The stepwise portion or squeezed portions fit in grooves of the frame 11, as illustrated in FIG. 12. A main or central portion 12*c* of the panel member 12 is recessed outward such that the main portion 12*c* extends from the space of the frame 11 as assembled. In an assembled structure, two main portions 12*c* support the vertical plates 17 therebetween. The main portion 12*c* also has a convexo-concave portion in the width direction (left and right direction in FIG. 3**) to ensure adequate rigidity.

The vertical plate 17 has approximately the same height as the main portion **12*c* of the panel 12. Two communication holes 26 are bored in each vertical plate 17. A plurality of vertical plates 17 are aligned at intervals such that the communication holes 26 are also aligned. The vertical plates 17 are connected to each other by connecting members (not shown) such as those illustrated in FIG. 1, thereby forming a single grid body 27**.

The grid body 27 is covered with the wick 20. Then, the main panel plate 24 and the auxiliary panel plate 25 are connected to each other with the grid body 27 and the wick 20 being housed between the main and auxiliary plates 24 and 25, spcifically housed in the main or center portions **12*c* of the plates 24 and 25. The U-shaped upper heat-transfer pipe 15 is provided in the upper space 12*a* in the plate 24 such that ends of the pipe 15 extend outward from a lateral face of the main panel plate 24. After the edges 12*e* of the plates 24 and 25 are joined with each other by the seam-welding and the extensions of the heat-transfer pipe 15 are also seam-welded to the plates 24 and 25, the panel body 12 is evacuated by a pipe 28 extending from the panel body 12. By the evacuation, the grid body 27 enclosed with the wick 20 adheres on the inner wall of the main portions 12*c* of the panel plates 24 and 25. This prevents deformation of the main portions 12*c*. After the evacuation, a desired amount of coolant 21 is charged into the pipe 28. Then, the pipe 28 is sealed and the assembling of the panel body 12** is completed.

In assembling the lower panel body 13, the vertical plates 18 are joined by the connecting plates 29 to form the grid body 30. The grid body 30 is then directly placed and housed between the main panel plate 31 and the auxiliary panel plate 32. The lower heat-transfer pipe 16 is provided to extend in the lower area of the panel body 13, as shown in FIG. 12 plates 31 and 32. The panel plates 31 and 32 are seam-welded to each other to define a container and the container is evacuated before the refrigerant 22 is charged thereinto.

The upper panel body 12 and the lower panel body 13 are mounted in the frame member 11 such that the former 12 is located above the latter 13.

Figure 13:
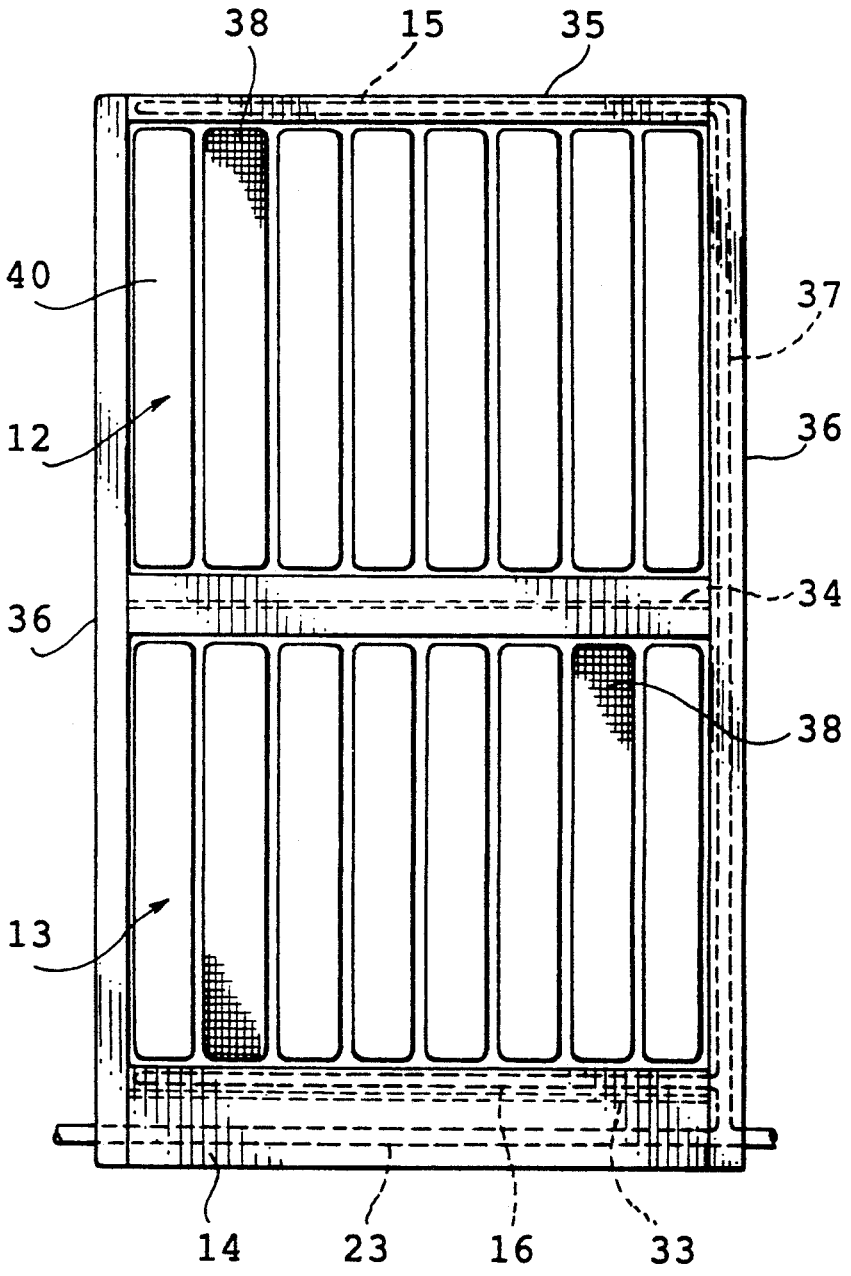
FIG. 13 is a front view of a modified version of FIG. 12.

The frame member 11 includes a lower sash bar 33, an intermediate sash bar 34 and an upper sash bar 35, all of which are integral with the header 14, as illustrated in FIG. 13. The bars 33, 34 and 35 extend generally in the horizonal direction and they are supported by vertically standing members 36 at respective both ends. The upper panel body 12 is provided in space defined by the upper sash bar 35, the middle sash bar 34 and the vertical members 36. Likewise the lower panel body 13 is provided in space defined by the middle sash bar 34, the lower sash bar 33 and the vertical members 36. A sheet of cloth 38 is put over the surface of the panel bodies 12 and 13.

The heat exchanger tubes 15 and 16 of the upper and lower panel bodies 12 and 13 are communicated with the cooling and heating fluid feed and discharge tubes 23 located in the header 14 via the connecting tubes 37. The connecting tubes 37 extend in the vertical poles 36. In the structure of FIG. 13, generally four connecting tubes 37 are necessary in separately feeding and discharging the cooling fluid and the heating fluid to and from the pipes 15 and 16. However, providing only two connecting tubes may be also satisfactory. Namely, the piping may be simplified by connecting entrances of the pipes 15 and 16 with each other by a single connecting tube 37 and exits of the pipes 15 and 16 are connected to each other by another connecting tube 37.

In addition, the frame 11 may have a construction other than that of FIG. 13. For example, two or more sets of the panel bodies 12 and 13 are disposed next to each other. Further, several sets of bodies 12 and 13 are arranged like an "L" as viewed from above, as shown in FIG. 12.

During the cooling operation, mainly the cooling fluid is supplied to the upper pipe 15 of the upper panel member 12 from the feed and discharge pipe 23 via the connecting tubes 37. During the heating operation, on the other hand, mainly the heating fluid is supplied to the lower pipe 16 of the lower panel member 13.

During the cooling operation, the refrigerant 21 in the upper panel member 12 is vaporized by heat input to the panel member 12. The vapor is condensed by the cooling fluid flowing in the uppper heat-exchange pipe 15. The liquid (condensed vapor) drops along the wick 20 and gets vaporized again by the heat input to the panel body 12, so as to cool the room. In this case, the cooling fluid may be or may not be fed to the heat-exchange pipe 16 of the lower panel body 13.

During the heating operation, the refrigerant 22 in the lower panel body 13 is heated and vaporized by the heating fluid flowing in the lower heat-exchange pipe 16. The vapor radiates its heat and gets condensed due to the heat radiation from the surface of the lower panel member 13. The fluid (condensed vapor) 22 is heated again by the heating fluid, so as to heat the room. Here, the heating fluid may be or may not be introduced to the heat-exchange pipe 15 of the upper panel member 12. Accordingly, head-cool and feet-warm air conditioning can be realized.

We claim:

1. A plate-type heat pipe unit comprising:

a relatively thin box-shaped panel body, the panel body having an inner thickness and opposite inner walls with coolant being charged in the panel body;

a heat-transfer pipe provided in an upper area in the panel body, the heat-transfer pipe having a surface, cooling fluid being fed to the heat-transfer pipe; and a grid body within the body panel and including a plurlaity of vertical plates, each vertical plate having approximately the same dimension as the inner thickness of the panel body; and a wick extending between the grid body and the inner walls of the panel body.

2. The heat pipe unit as defined in claim 1, wherein the wick is formed from metal mesh or cloth.

3. The heat pipe unit as defined in claim 1, further including a connecting member joining the vertical plates with each other.

4. A plate-type heat pipe unit comprising:

a relatively thin box-shaped panel body, the panel body having an inner thickness and opposite inner walls with coolant being charged in the panel body;

a heat-transfer pipe provided in an upper area in the panel body, the heat-transfer pipe having a surface, cooling fluid being fed to the heat-transfer pipe; and, means for guiding onto at least one of the inner walls of the panel body the coolant condensed at the surface of the heat-transfer pipe, the guiding means including (1) a grid body including a plurality of vertical plates, each vertical plate having approximately the same dimension as the inner thickness of the panel body, (2) at least two guide plates, the guide plates extending diagonally upward from the opposite inner walls of the panel body, respectively, and (3) a wick placed over the grid body so as to extend downward between the grid body and the inner walls of the panel body.

5. The heat pipe unit as defined in claim 4, wherein the guide plates are joined with each other at their extending free ends to form a single guide element.

6. The heat pipe unit as defined in claim 5, wherein the vertical plates are joined with each other by a connecting member such that the vertical plates and the connecting member define the grid body.

7. The heat pipe unit as defined in claim 4, wherein the vertical plates are joined with each other by a connecting member such that the vertical plates and the connecting member define the grid body.

8. The heat pipe unit as defined in claim 4, wherein the vertical plates are joined with each other by a connecting member such that the vertical plates and the connecting member define the grid body.

* * * * *